United States Patent [19]

Vercellotti

[11] 4,156,271

[45] May 22, 1979

[54] REFLECTOR LAMP

[75] Inventor: Joseph F. Vercellotti, Novelty, Ohio

[73] Assignee: General Electric Company, Schenectady, N.Y.

[21] Appl. No.: 683,616

[22] Filed: May 5, 1976

[51] Int. Cl.[2] ..... F21L 7/00; H01J 5/16

[52] U.S. Cl. ..... 362/202; 313/113

[58] Field of Search ..... 313/113, 222; 240/41 BM, 41 SB, 10.6 R, 10.6 CH, 10.66; 362/202

[56] References Cited

U.S. PATENT DOCUMENTS

| | | | |
|---|---|---|---|
| 1,286,800 | 12/1918 | Schulte | 240/10.6 R |
| 2,277,633 | 3/1942 | Ceader | 240/10.6 R |
| 2,575,790 | 11/1951 | Braunsdorff | 313/113 |
| 2,592,102 | 4/1952 | Alexander | 313/113 X |
| 2,818,498 | 12/1957 | Foch | 240/10.66 |
| 3,128,050 | 4/1964 | Parker | 240/10.66 |
| 3,209,138 | 9/1965 | Moore et al. | 240/10.6 R |
| 3,314,331 | 4/1967 | Wiley | 313/222 X |
| 3,462,803 | 8/1969 | Horton | 24/150 R |
| 3,488,543 | 1/1970 | De Ridder et al. | 313/113 |

FOREIGN PATENT DOCUMENTS

| | | | |
|---|---|---|---|
| 1958896 | 6/1971 | Fed. Rep. of Germany | 313/113 |

*Primary Examiner*—Donald A. Griffin

*Attorney, Agent, or Firm*—Paul F. Wille; Lawrence R. Kempton; Frank L. Neuhauser

[57] ABSTRACT

A reflector lamp is disclosed in which the lamp includes an integral reflector with the filament of the lamp in a predetermined relation with the focus of the reflector.

5 Claims, 3 Drawing Figures

Fig. 1
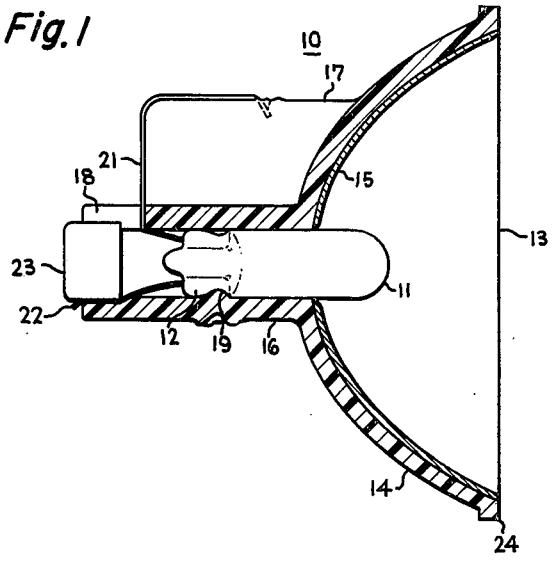
Fig. 2
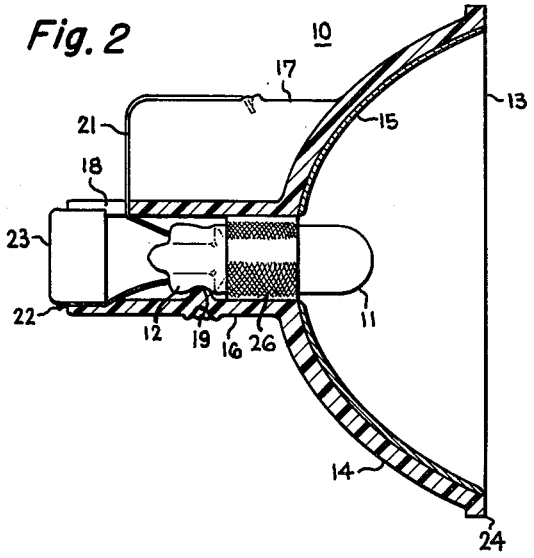
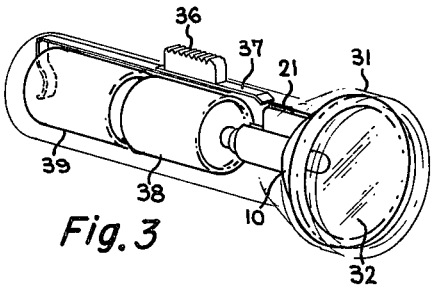
Fig. 3

REFLECTOR LAMP

BACKGROUND OF THE INVENTION

This invention relates to miniature lamps and, in particular, to miniature lamps having an integral reflector, for example, for use in flashlights.

Flashlights conventionally employ an efficient, short focal length, parabolic reflector and a prefocused type of incandescent lamp. "Efficient" refers to the light control ability of the reflector; specifically, to reflectors in which the plane of the open end of the reflector is located outside the focus from the vertex of the parabola. "Prefocused" refers to a lamp having a base collar from which the filament is located within predetermined tolerances. Prefocused lamps are necessitated by the combinations of lamp parts tolerances and variations in filament positioning introduced by the lamp making process.

The prefocused lamp is secured to the reflector in a variety of ways, including screw caps, coil springs, and leaf springs. Electrical contact is made to the bottom contact of the lamp base from the center contact of the batteries and to the lamp base shell by way of the flashlight switch.

While providing more controlled light than available without prefocused lamps, flashlights of the prior art do not have very closely controlled optics depending as they do on the fit of the bulb within its socket. Also, the reflector tends to deteriorate with time, further reducing the efficiency of the flashlight. In general, it is desired to produce a more efficient system at a reasonable price.

While lamps with integral reflectors are known outside the flashlight art, e.g., U.S. Pat. No. 3,488,543, these lamps use an all-glass reflector and do not hold the lamp in place by a portion of the bulb. Rather, the seal area of the lamp is embedded in cement and the lamp must be held in position while the cement dries.

SUMMARY OF THE INVENTION

In view of the foregoing, it is therefore an object of the present invention to provide an improved low power light source.

Another object of the present invention is to provide an improved flashlight lamp having an integral reflector.

A further object of the present invention is to provide an improved reflector lamp in which the bulb frictionally engages the reflector.

Another object of the present invention is to provide an improved flashlight lamp in which one contact for the lamp is formed on an index key to provide a contact to the lamp.

A further object of the present invention is to provide an improved reflector lamp which is easily assembled.

The foregoing objects are achieved in the present invention wherein an all-glass lamp is fitted in a plastic parabolic reflector having a reflective film on the interior surface thereof. The lamp is held in place by ultrasonic or thermal displacement of plastic into a ridge formed in the lamp. One lead is brought out over an index key formed in the reflector and the end of the lead secured to the key. The other lead frictionally engages a press-fit conductive plug inserted in the plastic. The plug provides a contact for the center contact of the battery and the key provides a contact for the switch in the flashlight.

BRIEF DESCRIPTION OF THE DRAWING

A more complete understanding of the present invention can be obtained by considering the following detailed description in conjunction with the accompanying drawings, in which:

FIG. 1 illustrates a cross section of the flashlight lamp in accordance with the present invention.

FIG. 2 illustrates a cross section of an alternative embodiment of the present invention.

FIG. 3 illustrates a flashlight using a lamp in accordance with the present invention.

DESCRIPTION OF THE PREFERRED EMBODIMENTS

Referring to FIG. 1, reflector lamp 10 generally comprises an all-glass vacuum or gas-filled incandescent lamp 11 attached to reflector 13. Lamp 11 may comprise any suitable lamp such as that disclosed in U.S. Pat. No. 3,798,491 and, in general, comprises a lamp having a pinch seal end 12 rather than a separate base. Reflector 13 comprises a paraboloidal section 14 having a suitable reflecting layer 15 deposited thereon, such as, but not limited to, vaporized aluminum. At the vertex of paraboloid 14 is a tubular section or hollow neck 16 which communicates to the interior of paraboloid 14 by an aperture at the vertex. Attached to paraboloid 14 and neck 16 is ridge or key 17 which extends radially from neck 16. Slot 18 is formed in the end of neck 16 and is radially aligned with key 17. As illustrated in FIG. 1, key 17 is preferably slightly shorter than neck 16.

Paraboloidal section 14 ends in rim 24 which serves to strengthen the edge of the reflector and define the axial alignment of the lamp within a flashlight. If desired, rim 24 may also contain suitable bosses or notches for defining the rotational alignment of the reflector lamp within a flashlight.

While lamp 11 is illustrated in FIG. 1 as closely fitting within the inside diameter of neck 16, the closeness of fit is not such as to prevent the movement of the lamp 11 along the axis of paraboloid 14. This enables reflector lamp 10 to be easily assembled and aligned by inserting lamp 11 through the lower end of neck 16 (as illustrated in FIG. 1) and adjusted in depth so that the filament of lamp 11 is at the focal point of paraboloid 14. This can be readily accomplished, for example, with an alignment tool having a planar portion against which the open end of paraboloid 14 rests and having a central pin or boss which locates lamp 11 along the axis of paraboloid 14.

Since lamp 11 is selected with the filament thereof within a specified location with respect to the upper end thereof, as opposed to the usual practice of locating the filament with respect to pinch seal end 12, the assembly of the reflector lamp is quickly and accurately accomplished. While thus located and frictionally engaging neck 16 with the bulbous portion of lamp 11, a portion of neck 16 is deformed, for example by an ultrasonically driven pin, to engage a notch or other suitable reference area 19 on the seal end 12 of lamp 11. While the use of ultrasonic deformation is the preferred form of longitudinally locating lamp 11, it is understood that other means may be employed, such as, but not limited to, thermal deformation, adhesives, cement, or heat-shrinkable tubing.

After lamp 11 is fixed with respect to the focus of paraboloid 14, one of the leads from lamp 11, such as lead 21, is threaded through slot 18 and positioned over key 17 as illustrated in FIG. 1. Preferably, the end of lead 21 is suitably anchored in key 17, for example by ultrasonic deformation. Lead 22 from lamp 11 is brushed over some other portion of the end of neck 16, and a plug 23 is press-fit into the end of neck 16, electrically and mechanically engaging lead 22. Plug 23 may comprise any suitable conductive material such as aluminum or brass. The depth of slot 18 is such that plug 23 will not engage both leads from lamp 11.

In a preferred embodiment of the present invention, reflector 13 comprises a thermoplastic such as polystyrene. However, other plastics or glasses may be used in accordance with the present invention.

FIG. 2 illustrates an alternative embodiment of the present invention where like elements with FIG. 1 bear the same reference numeral. Specifically, if it is desired to utilize a halogen-cycle lamp for lamp 11, the bulb temperature requirements of a halogen-cycle lamp may produce difficulties, depending upon the plastic utilized for reflector 13. It has been found however that plastic materials having a softening temperature below the bulb temperature of halogen-cycle lamps can be utilized for reflector 13 by the addition of an insulating sleeve 26 which may comprise any suitable material such as fiber glass. Except for the addition of sleeve 26, the construction and operation of the reflector lamp illustrated in FIG. 2 is identical with that of FIG. 1.

FIG. 3 illustrates a flashlight employing the reflector lamp of the present invention. Typically, a two-cell flashlight comprises a metal or plastic housing 31 having a glass or plastic lens 32. Lamp 10 is located behind lens 32 and aligned so that lead 21 is contacted by actuation of switch 36 which pushes conductor 37 into contact with lead 21. This closes the circuit comprising reflector lamp 10 and batteries 38 and 39. As previously noted, rim 24 may contain suitable bosses or notches for locating and aligning key 17 with respect to contact 37. Alternatively, case 31 of the flashlight may comprise suitable indexing means for locating key 17 with respect to contact 37.

There is thus provided by the present invention an improved optical system in which the lamp is accurately located with respect to the reflector and which is easily assembled. The operation of a flashlight utilizing the reflector lamp in accordance with the present invention is enhanced due to the superior optics of the reflector lamp as well as to the use of corrosion-resistant materials for the leads of the lamp and the fact that the reflector is replaced with the lamp when the lamp eventually burns out.

Having thus described the present invention, it will be apparent to those of skill in the art that various modifications can be made within the spirit and scope of the present invention. For example, a conductive annular ring could be utilized around the outside of neck 16 instead of key 17, thereby eliminating the need to align key 17 with switch contact 37. However, it is understood by those of skill in the art that such would add to the cost of the reflector lamp. Also, while described as particularly useful in flashlights, it is understood that the reflector lamp of the present invention has broader utility, e.g., in signal lamps for cars.

What I claim as new and desire to secure by Letters Patent of the United States is:

1. A lamp having an integral reflector comprising:
   - a paraboloidal surface having a reflective layer on the concave side thereof;
   - a tubular section extending from the convex side of said surface at the vertex of the paraboloid;
   - an all-glass incandescent lamp, having the filament located with respect to the end of the bulbous portion thereof, located within and protruding from said tubular section, said tubular section frictionally engaging the bulbous portion of said lamp and radially locating said lamp with respect to the axis of said paraboloid;
   - means for securing said lamp in position in a direction parallel to the axis of said paraboloid;
   - contact means connected to at least one of the wire leads from said lamp and further comprising a key connected to the convex side of said surface and to said tubular section, from which it extends radially;
   - wherein said contact means comprises a plug pressed into said tubular section, electrically and mechanically engaging said one lead and wherein said other lead is formed over said key.

2. The lamp as set forth in claim 1 wherein said tubular section contains a slot in the end thereof, said slot being radially aligned with said key and said other lead passing through said slot for electrically isolating said othe lead from said plug.

3. The lamp as set forth in claim 2 wherein the free end of said other lead is fastened to said key.

4. The lamp as set forth in claim 3 wherein said free end is embedded in said key.

5. In a flashlight comprising a case adapted to contain at least one electrical battery, a light source, a transparent cover for said light source, and a switch for selectively closing the electrical circuit between said battery and said light source, wherein the improvement is a light source comprising:
   - a reflector having a paraboloidal reflecting surface and a neck portion extending from the vertex of said paraloloidal surface, an all-glass incandescent lamp having the bulbous portion thereof partially contained within said neck to locate the filament of said lamp with respect to the focus of said paraboloidal reflector, and wherein said reflector further comprises a key extending radially from said neck and a lead from said lamp overlies said key for making contact with said switch.

* * * * *